United States Patent [19]

Besic et al.

[11] Patent Number: 4,963,077

[45] Date of Patent: Oct. 16, 1990

[54] PROFILED PLUNGER FOR A RECIPROCATING PUMP

[75] Inventors: Dragan Besic, West Caldwell; Wilbur C. Smith, North Caldwell, both of N.J.

[73] Assignee: Dresser Industries, Inc., Dallas, Tex.

[21] Appl. No.: 307,348

[22] Filed: Feb. 7, 1989

[51] Int. Cl.[5] ..... F04B 71/00

[52] U.S. Cl. ..... 417/437; 92/86.5

[58] Field of Search ..... 417/437, 439, 99; 92/86.5, 177

[56] References Cited

U.S. PATENT DOCUMENTS

| | | | |
|---|---|---|---|
| 1,025,554 | 5/1912 | Williams | 417/437 |
| 1,342,798 | 6/1920 | Farrand | 417/99 |
| 2,530,781 | 9/1943 | Langmyhr et al. | 417/432 |
| 2,545,506 | 3/1951 | Walsh | 417/382 |
| 3,146,940 | 9/1964 | McCrory et al. | 417/571 |
| 4,023,469 | 5/1977 | Miller | 92/86.5 |

FOREIGN PATENT DOCUMENTS

| | | | |
|---|---|---|---|
| 967427 | 5/1975 | Canada | 417/99 |

*Primary Examiner*—Michael Koczo
*Assistant Examiner*—Robert N. Blackmon

[57] ABSTRACT

A profiled plunger is provided for use with a reciprocating pump. A flushing chamber and a main pumping chamber of a reciprocating pump are connected by a connector having an aperture, the perimeter dimension of which is less than the internal perimeter dimension of the flushing chamber. A flushing space is defined between the connector and the profiled plunger. The profiled plunger is reciprocatingly mounted through the flushing chamber, connector, and the main pumping chamber. The perimeter dimension of the profiled plunger varies along its length in a predetermined manner in order to create a predetermined flow profile of flushing fluid through the aperture of the connector.

7 Claims, 3 Drawing Sheets

PROFILED PLUNGER FOR A RECIPROCATING PUMP

FIELD OF THE INVENTION

This invention relates to a reciprocating pump, and, in particular, to a reciprocating pump having a profiled plunger whereby the flow rate of a flushing fluid between the plunger and the plunger packing of the pump can be regulated to provide optimal flushing.

BACKGROUND OF THE INVENTION

Reciprocating pumps are commonly used to pump mixtures of liquids and solids for process and transportation purposes. Reciprocating pumps are particularly suited to these applications because of their relatively low flow velocities compared to centrifugal pumps. Lower velocity pumps are preferable for use in pumping mixtures of liquids and solids because erosive wear rates have been found to be proportional to a fairly high exponent (3 to 4) of the relative velocity of the pump. However, the close operating clearances required in reciprocating pumps, such as at the plunger or piston rod packing, are particularly subject to abrasive wear. For this reason, it is desirable to provide a reciprocating pump with a flushing means in order to minimize the presence of abrasive particles in these close clearance areas.

SUMMARY OF THE INVENTION

The reciprocating pump of the present invention provides a profiled plunger capable of providing a predetermined flow velocity profile of flushing fluid through the close clearance areas of the reciprocating pump plunger in order to maximize the removal of abrasive materials from these areas.

The reciprocating pump of the present invention has a main pumping chamber and a flushing chamber connected by a connecting means. A channel formed through the connecting means has a perimeter dimension less than the internal perimeter dimension of the flushing chamber. A plunger is reciprocatingly mounted through the main pumping chamber, the channel through the connecting means, and the flushing chamber. A flushing space is defined between the connecting means and the plunger, and permits the flow of flushing fluid from the flushing chamber to the main pumping chamber. The plunger of the present invention has a varying perimeter dimension along its length. As the plunger reciprocates through the connecting means, the flushing space increases and decreases in dimension in a predetermined manner causing a variation of flow through the flushing space.

In a preferred embodiment, the perimeter measure of the plunger varies along its length such that the dimensions of the space are minimized when the plunger is in its top dead center and bottom dead center positions. In this embodiment, the plunger is profiled such that the velocity of flushing fluid through the connecting means is substantially constant throughout the cycle of the pump. This embodiment provides better flushing abilities than non-profiled plungers.

BRIEF DESCRIPTION OF THE DRAWINGS

For a more complete understanding of the present invention and further advantages thereof, reference is now made to the following Description of the Preferred Embodiment taken in conjunction with the accompanying Drawings in which.

DETAILED DESCRIPTION

Figure 1:
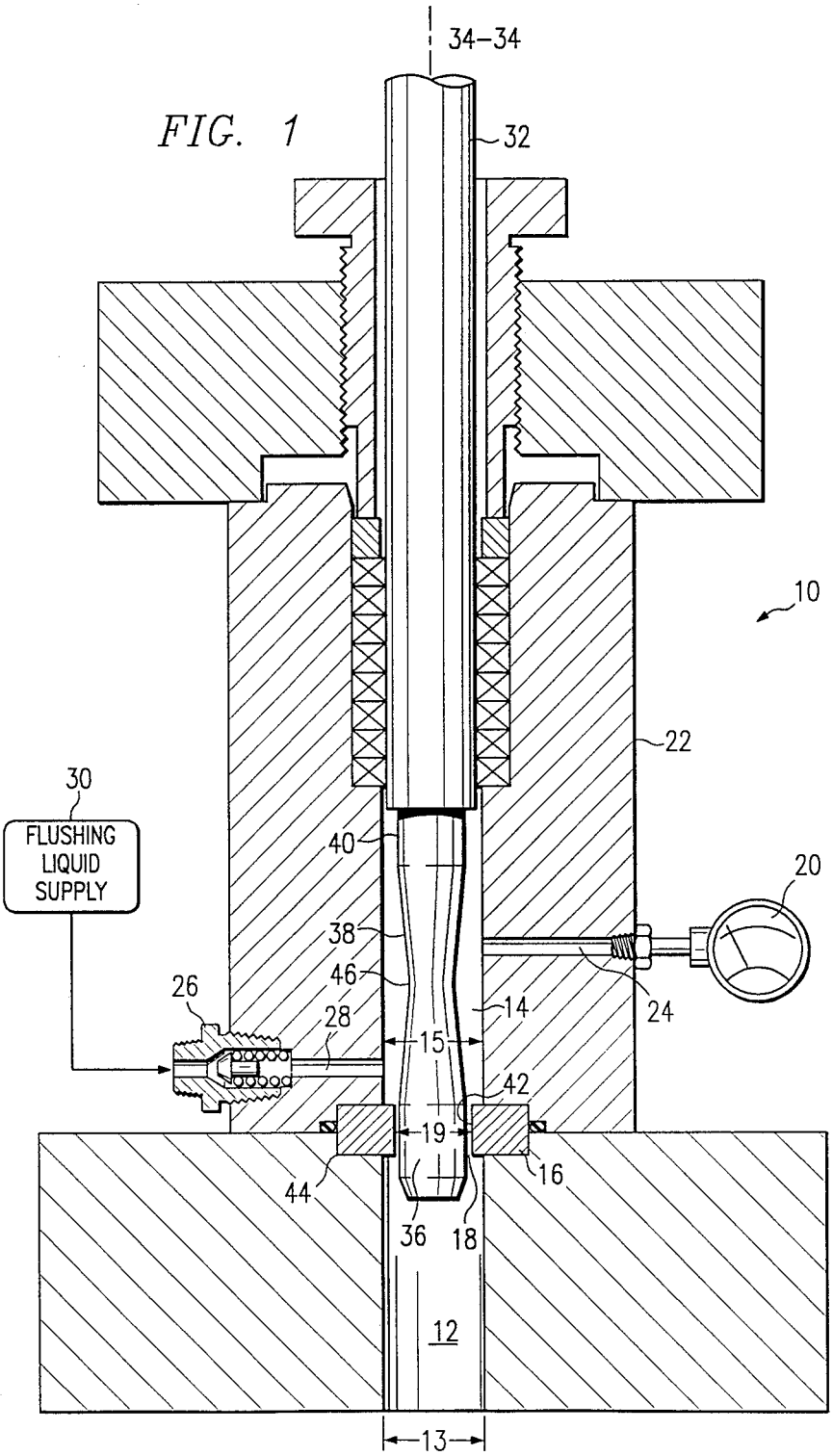
FIG. 1 is a partial cross sectional view of the reciprocating pump of the present invention with the plunger in the top dead center position.

A reciprocating pump of the present invention is generally identified by reference numeral 10. Reciprocating pump 10 includes a main pumping chamber 12 and flushing chamber 14. Main chamber 12 and flushing chamber 14 may have any cross sectional form. In the preferred embodiment depicted in FIGS. 1–3, main chamber 12 and flushing chamber 14 have circular cross sections of diameters 13 and 15, respectively. Reciprocating pump 10 also includes connecting means 16 having a circular cross section aperture 18 formed, therethrough. Connecting means 16, main chamber 12, and flushing chamber 14 are mounted coaxially in reciprocating pump 10. The diameter 19 of aperture 18 is preferably less than the diameter 15 of flushing chamber 14 in order to provide optimal flow regulation between flushing chamber 14 and main chamber 12.

Pressure gauge 20 may be mounted on exterior surface 22 of flushing chamber 14. Channel 24 connects flushing chamber 14 and pressure gauge 20 such that pressure gauge 20 is capable of measuring the internal pressure of flushing chamber 14.

A check valve 26 is mounted through exterior surface 22 of flushing chamber 14 and fluidly communicates with flushing chamber 14 through channel 28. Flushing fluid source 30 is connected to check valve 26 such that flushing fluid is unidirectionally transmitted through check valve 26 and channel 28 to flushing chamber 14 when the pressure of flushing fluid source 30 exceeds the internal pressure of flushing chamber 14. Conversely, when the internal pressure of flushing chamber 14 exceeds the pressure in flushing fluid source 30, check valve 26 is closed, shutting off the flow of flushing fluid between flushing fluid source 30 and flushing chamber 14.

Plunger 32 is mounted for reciprocating movement through flushing chamber 14, connecting means 16, and main chamber 12 such that longitudinal axis 34—34 of plunger 32 is coaxial to the axes of flushing chamber 14, connecting means 16, and main pumping chamber 12. Plunger 32 can be used in conjunction with any known means for producing reciprocating motion. Plunger 32 can have numerous profiles, each of which is constructed to create specific flushing fluid flow characteristics. The following description is, however, limited to the preferred embodiment of plunger 32 depicted in the accompanying drawings.

In the preferred embodiment, plunger 32 has a circular cross section along its length and has a first portion 36 having a substantially constant perimeter dimension along its length. Extending from first portion 36 is profiled portion 38. Third portion 40 extends from profiled piston portion 38. First portion 36, profiled portion 38, and third portion 40 are coaxial with axis 34—34 of plunger 32. Third portion 40 preferably has a constant perimeter dimension along its length equivalent to the perimeter dimension of first portion 36.

Figure 2:
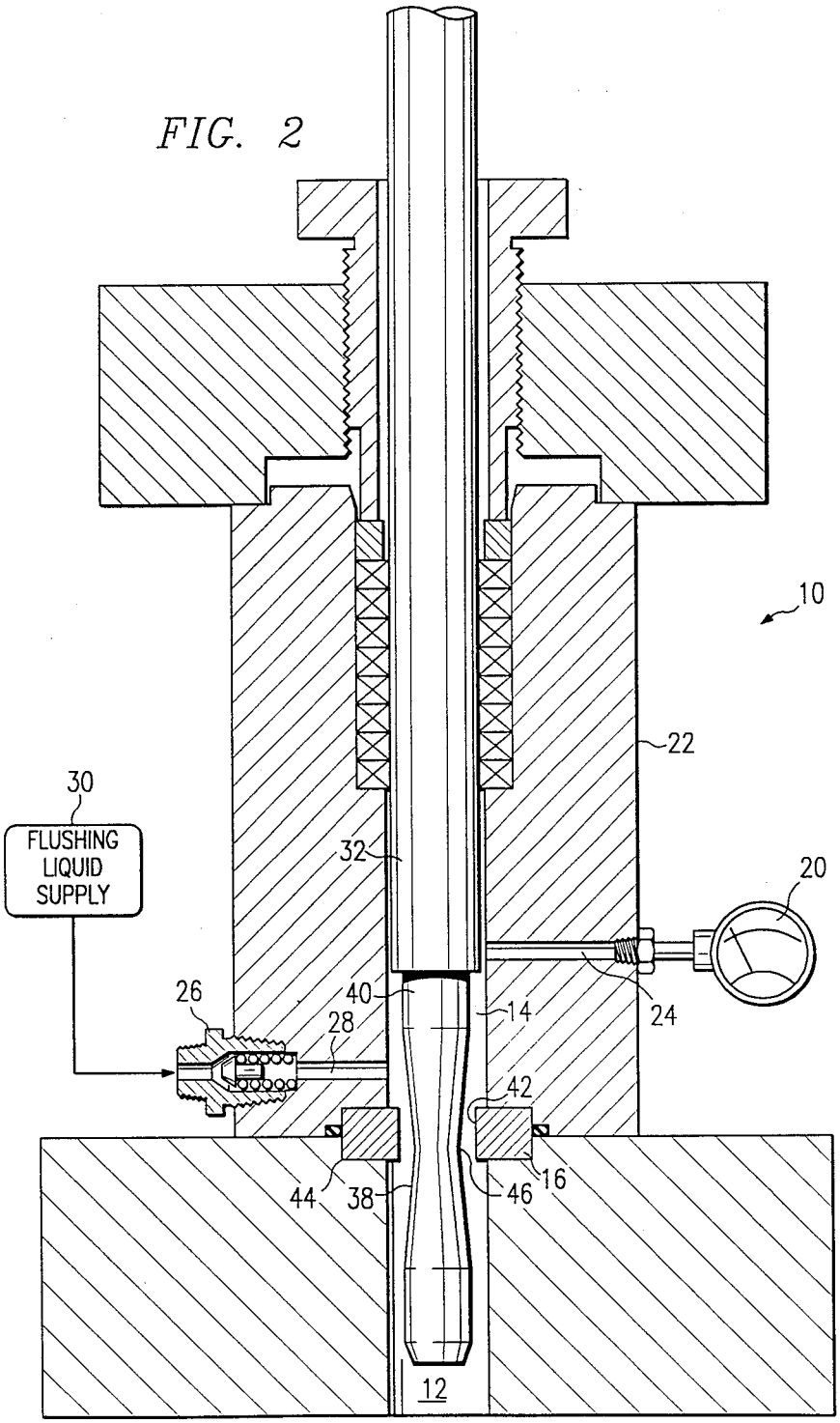
FIG. 2 is a partial cross sectional view of the reciprocating pump of the present invention with the plunger having completed approximately 40% of its discharge stroke.

Flushing space 42 is defined within aperture 18 by plunger 32 and connecting means 16. During reciprocation of plunger 32, the dimensions of flushing space 42 remain constant as first portion 36 passes through distal end 44 of aperture 18, as best seen in FIG. 1. However, as depicted in FIG. 2 and described in detail below, when profiled portion 38 passes through aperture 18, the dimensions of flushing space 42 are varied, causing the flow characteristics of flushing fluid through connecting means 16 to be correspondingly varied. In the embodiment depicted in FIGS. 1–3, the dimension of flushing space 42 initially increases as profiled portion 38 passes through connecting means 16, causing the volume of flushing fluid flow through connecting means 16 to increase while the flow velocity remains substantially constant. It is to be appreciated that flow velocity is dependent upon both the dimension of flushing space 42 and the absolute velocity of plunger 32. When a predetermined position 46 of profiled portion 38 passes through distal end 44 of aperture 18, the dimension of flushing space 42 begins to decrease, thus reducing the flow volume through connecting means 16, but again maintaining a substantially constant flow velocity. The ability of profiled plunger 32 to deliver a substantially constant flow velocity is the result of pressure in flushing chamber 14 created by flushing fluid source 30 and/or the outward stroke of profiled plunger 32 and the result of the absolute velocity of plunger 32. Thus, in this preferred embodiment, the profile of portion 38 varies in direct relation to the absolute velocity of plunger 32.

Figure 3:
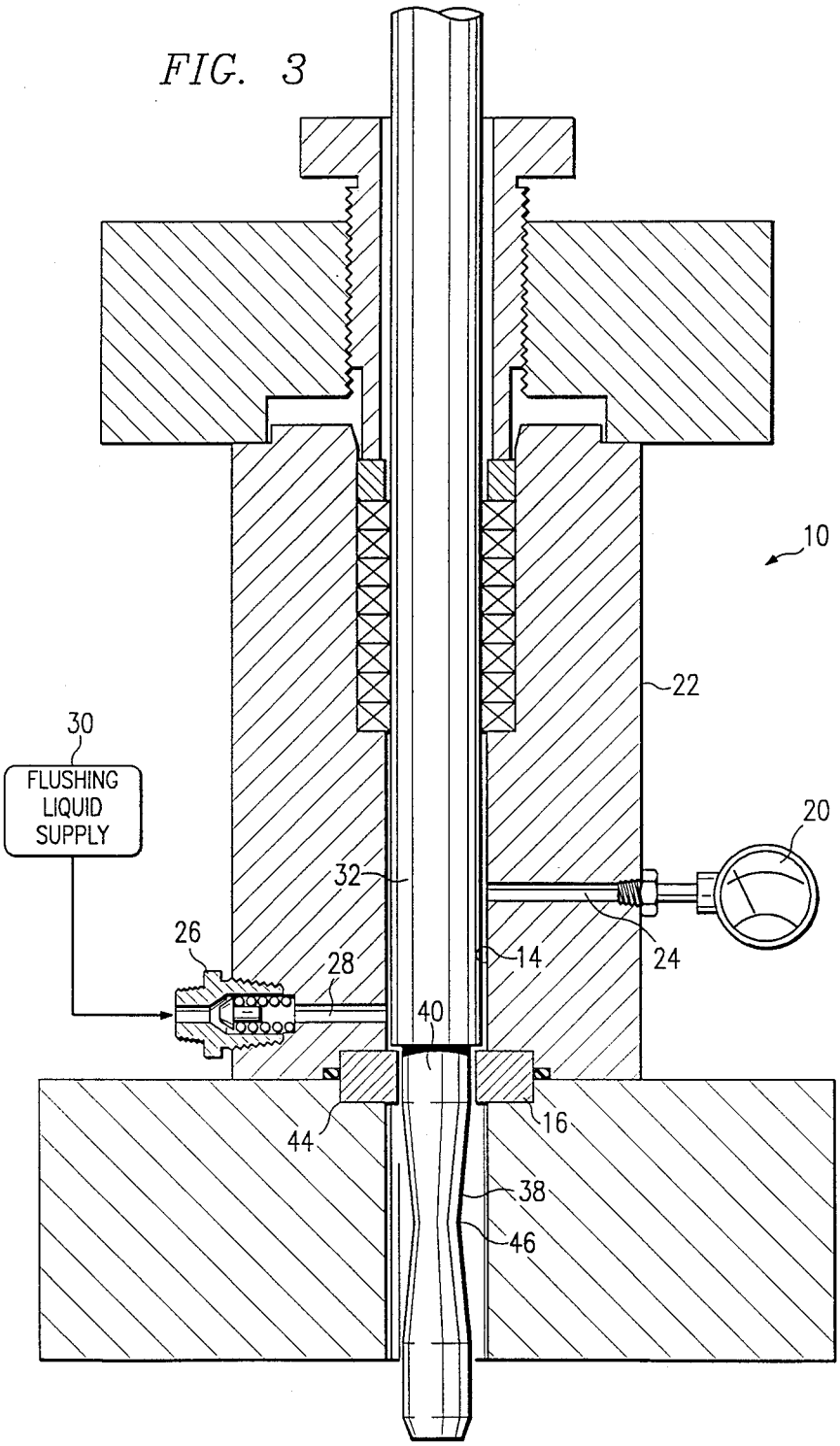
FIG. 3 is a partial cross sectional view of the reciprocating pump of the present invention with the plunger in its bottom dead center position.

When plunger 32 is in its top dead center position depicted in FIG. 1, flushing space 42 has its minimum dimension and flow of flushing fluid from flushing chamber 14 to main chamber 12 is solely the result of the pressure in flushing fluid source 30. As plunger 32 begins its outward stroke, the pressure in flushing chamber 14 increases due to the displacement of fluid therein by plunger 32 causing check valve 26 to close. This increase in pressure of flushing fluid in flushing chamber 14 causes the velocity of flushing fluid through aperture 18 to increase to a predetermined level. When the velocity of flushing fluid through aperture 18 reaches its predetermined level, profiled portion 38 begins to pass through distal end 44 of aperture 18. Profiled portion 38 decreases in perimeter dimension from its border with first portion 36 to a predetermined position 46 on profiled portion 38. Thus, as profiled portion 38 passes through distal end 44 of connecting means 16, the dimension of flushing space 42 increases until predetermined position 46 on profiled portion 38 clears distal end 44 of aperture 18. Subsequently, the dimensions of annular flushing space 42 decrease until third portion 40 is positioned at distal end 44 of aperture 18. When plunger 32 reaches its bottom dead center position, as depicted in FIG. 3, the dimension of flushing space 42 is again at its minimum and the flow of flushing fluid through aperture 18 is once again solely the result of pressure from flushing fluid source 30.

Through the use of the profiled plunger of the preferred embodiment of the present invention, a minimum flushing fluid velocity is maintained throughout the stroke of the pump. It is to be appreciated that as plunger 32 moves from its bottom dead center position to its top dead center position, the velocity of flushing fluid through aperture 18 is maintained at a substantially constant velocity due to the pressure of flushing fluid in flushing fluid source 30.

It is also to be appreciated that plunger 32 can be profiled in order to provide nearly any desired flow profile for flushing fluid through flushing space 42. The preferred embodiment described in detail herein represents only one possible profile for plunger 32. Various changes and modifications to plunger 32 may be suggested to one skilled in the art and it is intended that the present invention encompass such changes and modifications as fall within the scope of the appended claims.

What is claimed is:

1. A reciprocating pump, said pump comprising:

a first housing section, said first section having a main pumping chamber defined therein, said main pumping chamber having an internal perimeter dimension;

a second housing section, said second section having a flushing chamber defined therein, said flushing chamber having an internal perimeter dimension;

a means for connecting said first housing section and said second housing section, said means for connecting having an aperture formed therethrough, said aperture having a perimeter dimension less than said internal perimeter dimension of said flushing chamber, said aperture fluidly connecting said main pumping chamber and said flushing chamber;

a means for supplying flushing fluid to said flushing chamber;

a plunger mounted for reciprocating movement through said main pumping chamber, said aperture through said means for connecting, and said flushing chamber, said means for connecting and said plunger defining a flushing space therebetween, said plunger having a varying perimeter dimension along its length whereby the dimensions of said flushing space defined between said connecting means and said plunger vary as said plunger reciprocates through said means for connecting; and means for reciprocating said plunger.

2. The reciprocating pump of claim 1 wherein said reciprocating pump has a top dead center position and a bottom dead center position, said flushing space defined between said means for connecting and said plunger having its minimum dimension when said plunger is in said top dead center position and in said bottom dead center position.

3. The reciprocating pump of claim 2 wherein said perimeter dimension of said plunger varies in relation to the absolute velocity of said plunger as it reciprocates through said main pumping chamber, said flushing chamber, and said aperture through said means for connecting, whereby the velocity of fluid forced through said flushing space is substantially constant throughout the pumping cycle of said reciprocating pump.

4. The reciprocating pump of claim 1 wherein said main pumping chamber, said connecting means, said flushing chamber, and said plunger are circular in cross section.

5. The reciprocating pump of claim 1 wherein said means for supplying flushing fluid comprises:

a flushing fluid source;

a check valve mounted in fluid connection with said flushing chamber; and a means for supplying flushing fluid from said flushing fluid source to said check valve.

6. The reciprocating pump of claim 1 wherein said means for connecting comprises a throat bushing.

7. A reciprocating pump for pumping mixtures of liquids and solids, said pump comprising:

a first housing section, said first housing section having a cylindrical main pumping chamber defined therein, said main pumping chamber having an internal perimeter dimension;

a second housing section, said second housing section having a cylindrical flushing chamber defined therein, said flushing chamber having an internal perimeter dimension;

a means for connecting said first housing second and said second housing section, said means for connecting having a cylindrical aperture formed therethrough, said aperture having a perimeter dimension less than said internal perimeter dimension of said flushing chamber, said aperture fluidly connecting said main pumping chamber and said flushing chamber, said main pumping chamber, said aperture, and said flushing chamber being coaxially mounted;

a means for supplying flushing fluid under pressure to said flushing chamber;

a plunger mounted for reciprocating movement through said main pumping chamber, said aperture through said means for connecting, and said flushing chamber, said means for connecting and said plunger defining a flushing space therebetween, said plunger comprising a first section having a substantially constant perimeter dimension, a second section having a perimeter dimension which varies in relation to the absolute velocity of said plunger as it reciprocates within said reciprocating pump, and a third section having a substantially constant perimeter dimension, said first section, said second section, and said third section being coaxially mounted; and means for reciprocating said plunger.

* * * * *